US007854113B2

(12) United States Patent
Kawakita et al.

(10) Patent No.: US 7,854,113 B2
(45) Date of Patent: Dec. 21, 2010

(54) CATALYST TEMPERATURE ESTIMATION DEVICE

(75) Inventors: Koji Kawakita, Ohbu (JP); Katsunori Ueda, Okazaki (JP); Toshiyuki Miyata, Okazaki (JP); Katsuhiro Furuta, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 887 days.

(21) Appl. No.: 11/798,869

(22) Filed: May 17, 2007

(65) Prior Publication Data

US 2007/0266696 A1 Nov. 22, 2007

(30) Foreign Application Priority Data

May 19, 2006 (JP) ..... 2006-140162

(51) Int. Cl.
*F01N 3/00* (2006.01)
*F01N 3/10* (2006.01)
*F01N 3/02* (2006.01)

(52) U.S. Cl. ..... 60/276; 60/297; 60/299; 60/311

(58) Field of Classification Search ..... 60/276, 60/277, 285, 299, 295, 297, 311
See application file for complete search history.

(56) References Cited

U.S. PATENT DOCUMENTS

2006/0027012 A1* 2/2006 Allmendinger ..... 73/23.31
2006/0069494 A1* 3/2006 Yamada et al. ..... 701/108
2008/0302084 A1* 12/2008 Oswald et al. ..... 60/276

FOREIGN PATENT DOCUMENTS

| | | | |
|---|---|---|---|
| CN | 1213604 A | | 4/1999 |
| CN | 2384757 Y | | 6/2000 |
| CN | 1419027 A | | 5/2003 |
| JP | 10-026034 A | | 1/1998 |
| JP | 2004-60563 A | | 2/2004 |
| JP | 2004-263606 A | | 9/2004 |
| JP | 2004346865 A | * | 12/2004 |
| JP | 2006-029141 A | | 2/2006 |
| WO | WO-2005/124117 A1 | | 12/2005 |
| WO | WO 2005124117 A1 | * | 12/2005 |

OTHER PUBLICATIONS

Koseki, Machine Translation of JP 2004-346865 A, Dec. 9, 2004.*
Koseki, English Abstract of JP 2004-346865 A, Dec. 9, 2004.*

* cited by examiner

*Primary Examiner*—Thomas E Denion
*Assistant Examiner*—Audrey Klasterka
(74) *Attorney, Agent, or Firm*—Birch, Stewart, Kolasch & Birch, LLP

(57) ABSTRACT

In a fuel cut period, an adsorbed CO quantity calculation section calculates the amount CATco of CO adsorbed on a catalyst, and an exhaust $O_2$ quantity calculation section calculates the amount $GASo_2$ of $O_2$ in exhaust gases. CO oxidation reaction heat $\Delta H_r$ produced when the calculated amount CATco of adsorbed CO reacts with the calculated amount $GASo_2$ of $O_2$ in the exhaust gases is calculated by a $\Delta H_r$ calculation section, and used in estimation of the temperature of the catalyst.

12 Claims, 7 Drawing Sheets

CATALYST TEMPERATURE ESTIMATION DEVICE

BACKGROUND OF THE INVENTION

1. Field of the Invention

This invention relates to a catalyst temperature estimation device for estimating the temperature of a catalyst of a catalytic converter for converting exhaust to less harmful substances.

2. Description of the Related Art

A catalytic converter for converting harmful substances in exhaust gases, such as HC (carbon hydrate), CO (carbon monoxide) and NOx (nitrogen oxide), to less harmful substances is provided in an exhaust system of an engine. The temperature of the catalyst of such catalytic converter varies to a great degree depending on the operating state of the engine. Thus, it is necessary to control the engine appropriately, on the basis of the estimated value of the catalyst temperature, so that the catalyst temperature will not exceed the allowable temperature limit for the catalytic converter in any operating state. There is known a catalyst temperature estimation technique in which exhaust temperature in steady operation is stored, and exhaust temperature in transient operation is estimated by subjecting the stored temperature in steady operation to filtering.

When a fuel cut is performed for vehicle deceleration, a large amount of oxidation reaction heat is produced by a reaction in which $O_2$ (oxygen) in the exhaust gases reacts with CO and HC adsorbed on the catalyst. Meanwhile, in a fuel recovery period after the termination of the fuel cut, a large amount of conversion reaction heat is produced by a reaction in which CO and HC in the exhaust gases are converted by $O_2$ that was adsorbed onto the catalyst during the fuel cut. In either case, a rapid rise in catalyst temperature is caused, which makes it particularly difficult to estimate the catalyst temperature. The above-mentioned catalyst temperature estimation technique only estimates the rate of change of temperature in such transient operation to be smaller than that in steady operation, through filtering. Thus, especially when the fuel cut and fuel recovery is repeated frequently, there occurs a problem that the values departing much from the actual catalyst temperature are estimated, as indicated in dashed line in the time chart of FIG. 7.

A catalyst temperature estimation technique different from the above has also been proposed (see Japanese Unexamined Patent Publication No. 2004-263606, for example). In the technique disclosed in this publication, in the operating states other than that with a fuel cut, the temperature of exhaust from the engine is considered as standard catalyst temperature; from the standard catalyst temperature, exhaust pipe wall temperature is estimated; From the standard catalyst temperature and the exhaust pipe wall temperature, provisional catalytic-converter inflow exhaust temperature is estimated; then, catalytic-converter inflow exhaust temperature taking account of a drop in exhaust temperature due to running wind is estimated from the provisional catalytic-converter inflow exhaust temperature; and on the basis of this catalytic-converter inflow exhaust temperature, catalyst temperature is estimated. Meanwhile, in the operation with a fuel cut, this estimation process is suspended, and the value of the catalyst temperature estimated in the last processing cycle is used as the present value without change.

However, the use of the last value as the present value without change in the fuel cut period, as in the catalyst temperature estimation technique disclosed in the above-mentioned publication, means that the estimation is performed on the assumption that the catalyst temperature does not vary in the fuel cut period and the fuel recovery period. This results in great departure of estimated values from the actual catalyst temperature which shows a rapid rise due to the oxidation reaction of HC and CO, like the case of the conventional technique shown in FIG. 7, for example. Consequently, it is impossible to suppress a rise in catalyst temperature in the fuel cut period and the fuel recovery period, by performing engine control on the basis of the catalyst temperature estimated by this estimation technique. Accordingly, this estimation technique has a problem that the catalyst temperature rises beyond the allowable temperature limit, which causes damage to the catalytic converter.

SUMMARY OF THE INVENTION

This invention has been made to solve the problems as mentioned above. The primary object of this invention is to provide a catalyst temperature estimation device which can accurately estimate movements of the catalyst temperature also in the fuel cut period and the fuel recovery period of the engine, and which can therefore prevent the catalytic converter from being damaged by a rise in temperature beyond the allowable temperature limit.

To achieve this object, the catalyst temperature estimation device according to the present invention comprises a catalytic converter carrying a catalyst disposed in an exhaust passage of an engine for converting exhaust gases to less harmful substances; an adsorbed unburnt-fuel-component quantity calculation element for calculating the amount of an unburnt fuel component adsorbed on the catalyst in a fuel cut period of the engine; an exhaust $O_2$ quantity calculation element for calculating the amount of $O_2$ in the exhaust gases in the fuel cut period; an oxidation reaction heat calculation element for calculating reaction heat produced when the adsorbed unburnt fuel component in the amount calculated by the adsorbed unburnt-fuel-component quantity calculation element reacts with $O_2$ in the exhaust gases in the amount calculated by the exhaust $O_2$ quantity calculation element; and a catalyst temperature estimation element for estimating the temperature of the catalyst in the fuel cut period, on the basis of the reaction heat calculated by the oxidation reaction heat calculation element.

Thus, in the fuel cut period, the amount of the unburnt fuel component adsorbed on the catalyst is calculated by the adsorbed unburnt-fuel-component quantity calculation element, the amount of $O_2$ in the exhaust gases is calculated by the exhaust $O_2$ quantity calculation element, the reaction heat produced when the unburnt fuel component in the calculated amount reacts with $O_2$ in the calculated amount is calculated by the oxidation reaction heat calculation element, and the temperature of the catalyst is estimated by the catalyst temperature estimation element on the basis of the calculated reaction heat.

In the fuel cut period, a large amount of reaction heat is produced by an oxidation reaction in which unburnt fuel components such as CO and HC adsorbed on the catalyst is oxidized by a large amount of $O_2$ in the exhaust gases, and this reaction heat causes a rapid rise in catalyst temperature. With the configuration described above, the catalyst temperature estimation device according to the present invention can estimate the catalyst temperature taking account of the reaction heat in such phenomenon. Accordingly, it can estimate movements of the catalyst temperature in the fuel cut period, accurately, and therefore prevent the catalytic converter from being damaged by a rise in temperature beyond the allowable temperature limit.

The catalyst temperature estimation device according to the present invention can further comprise an operating state detection element for detecting the operating state of the engine; an $O_2$ storage index calculation element for calculating an $O_2$ storage index correlating with the amount of $O_2$ adsorbed on the catalyst; an air-fuel ratio estimation element for estimating air-fuel ratio on the catalyst; and a conversion reaction heat calculation element for calculating reaction heat produced by a conversion reaction on the catalyst in a fuel recovery period of the engine, on the basis of the operating state of the engine detected by the operating state detection element, the $O_2$ storage index calculated by the $O_2$ storage index calculation element, and the air-fuel ratio estimated by the air-fuel ratio estimation element, wherein the catalyst temperature estimation element estimates the temperature of the catalyst in the fuel cut period on the basis of the reaction heat calculated by the oxidation reaction heat calculation element, and in the fuel recovery period on the basis of the reaction heat calculated by the conversion reaction heat calculation element.

Thus, in the fuel recovery period, the operating state of the engine is detected by the operating state detection element, the $O_2$ storage index correlating with the amount of $O_2$ adsorbed on the catalyst is calculated by the $O_2$ storage index calculation element, and the air-fuel ratio on the catalyst is estimated by the air-fuel ratio estimation element. On the basis of these engine operating state, $O_2$ storage index and air-fuel ratio, reaction heat produced by a conversion reaction on the catalyst is calculated by the conversion reaction heat calculation element, and on the basis of the calculated reaction heat, the temperature of the catalyst is estimated by the catalyst temperature estimation element.

In the fuel recovery period, a large amount of reaction heat is produced by a conversion reaction in which CO and HC in the exhaust gases are converted by $O_2$ that was adsorbed onto the catalyst during the fuel cut, and this reaction heat causes a rapid rise in catalyst temperature. With the configuration described above, the catalyst temperature estimation device according to the present invention can estimate the catalyst temperature taking account of the reaction heat in such phenomenon. Accordingly, it can estimate movements of the catalyst temperature accurately not only in the fuel cut period but also in the fuel recovery period.

A further scope of applicability of the present invention will become apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 6 is a control block diagram showing how the processing by a catalyst temperature estimation section of the ECU goes on.

DETAILED DESCRIPTION OF THE INVENTION

A catalyst temperature estimation device which is an embodiment of the present invention will be describe below.

Figure 1:
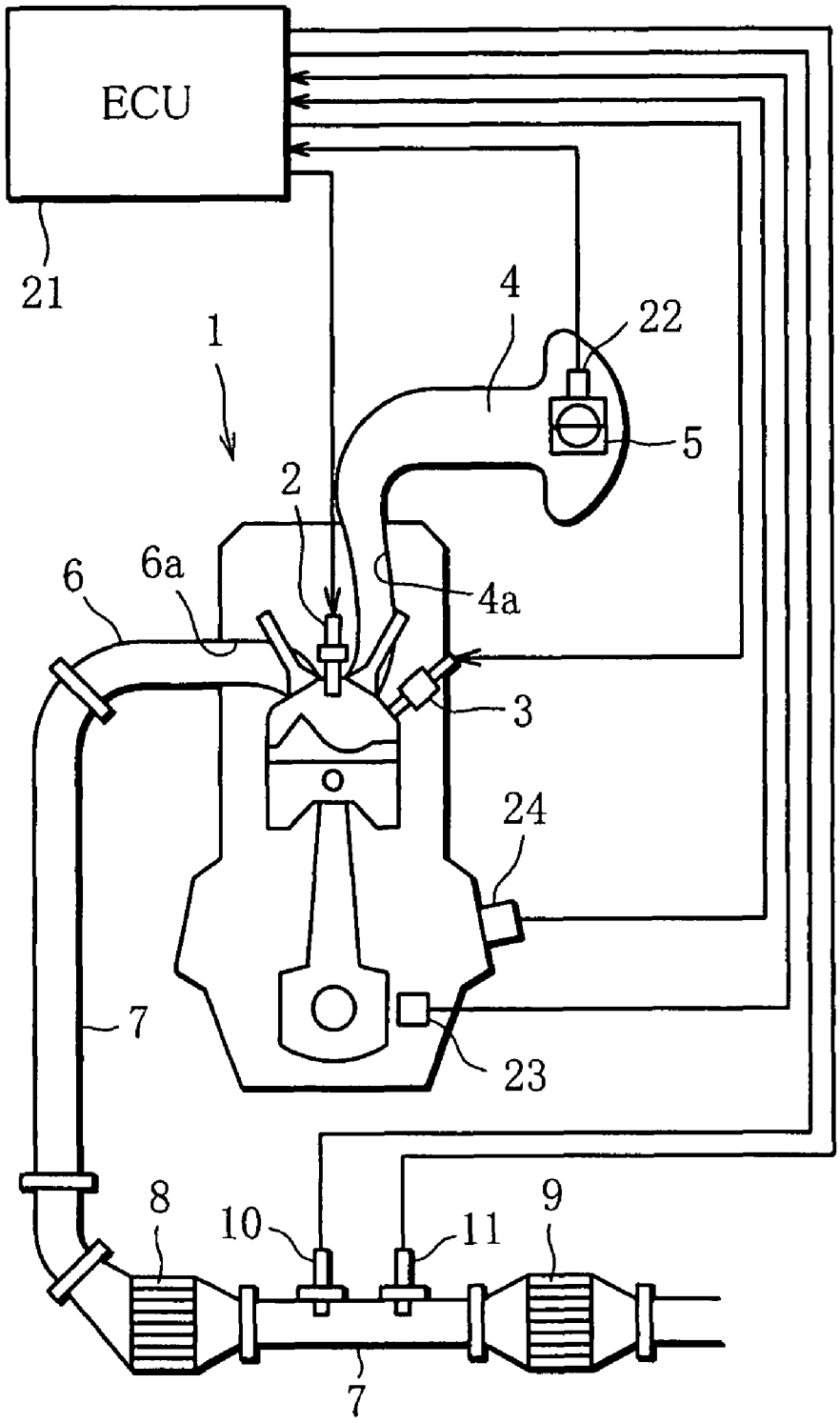
FIG. 1 is a diagram showing the entire configuration of an embodiment of the catalyst temperature estimation device.

FIG. 1 is a diagram showing the entire configuration of this embodiment of the catalyst temperature estimation device. An engine 1 is a direct-injection spark-ignition four-cylinder-in-line gasoline engine. A spark plug 2 and an electromagnetic fuel injection valve 3, provided for each cylinder, are fitted to a cylinder head of the engine 1. From the fuel injection valve 3, fuel is injected directly into a combustion chamber. The cylinder head has intake ports 4*a* formed for the respective cylinders, which extend almost upright. The intake ports 4*a* are connected to a throttle valve 5 through an intake manifold 4, and the throttle valve 5 is connected to an intake passage (not shown).

The cylinder head also has exhaust ports 6*a* extending almost horizontally, and the exhaust ports 6*a* are connected to an exhaust passage 7 through an exhaust manifold 6. An early catalytic converter 8 is disposed in the upstream part of the exhaust passage 7, while an underfloor catalytic converter 9 is disposed in the downstream part of the exhaust passage 7. The early catalytic converter 8 and the underfloor catalytic converter 9 are three-way catalytic converters carrying a precious metal such as platinum (Pt), rhodium (Rh) or the like. In the present embodiment, temperature estimation is performed for the underfloor catalytic converter 9. It is, however, to be noted that the temperature estimation is not limited to the underfloor catalytic converter 9 but can be carried out for the early catalytic converter 8 or an NOx adsorption catalytic converter for conversion of NOx (not shown), for example. Upstream of the underfloor catalytic converter 9, an air-fuel ratio sensor 10 (exhaust air-fuel ratio detection element) is provided. The air-fuel ratio sensor 10 detects the air-fuel ratio of exhaust gases flowing into the underfloor catalytic converter 9.

In a vehicle compartment, an ECU (electronic control unit) 21 including an input-output device, memory (ROM, RAM, nonvolatile RAM, etc.), a central processing unit (CPU), a timer counter, etc. is installed. To the input of the ECU 21, various sensors, such as the above-mentioned air-fuel ratio sensor 10, a throttle sensor 22 for detecting the opening of the throttle valve 5, a revolving rate sensor 23 for detecting the revolving rate of the engine 1, and a water temperature sensor 24 for detecting the temperature of a coolant, are connected. From these sensors, detection information is fed to the ECU. To the output of the ECU 21, various devices, such as the above-mentioned spark plugs 2 and fuel injection valves 3, are connected.

The ECU 21 determines ignition timing and fuel injection timing on the basis of the detection information from the sensors, and makes the engine 1 operate by drive-controlling the spark plugs 2 and fuel injection valves 3 on the basis of determined control quantities. When the conditions set for fuel cut, such that the vehicle is being decelerated with an accelerator deactivated and that the vehicle speed is greater than or equal to a determined value, are satisfied, the ECU 21 stops fuel injection by performing a fuel cut, and when the conditions set for fuel recovery, such that the accelerator is activated, are satisfied, the ECU 21 resumes fuel injection.

As stated under the subheading "Description of the Related Art", in the fuel cut period and the fuel recovery period, the catalyst temperature $T_{catf}$ is difficult to estimate due to a rapid rise in temperature in the underfloor catalytic converter 9, which necessarily makes it difficult to appropriately perform engine control on the basis of the catalyst temperature $T_{catf}$ in order to suppress a rise in temperature. Thus, in the present embodiment, temperature estimation for the underfloor catalytic converter 9 is performed taking account of reaction heat produced in the fuel cut period and the fuel recovery period. This temperature estimation will be described below in detail.

Prior to entering the description of the temperature estimation, reactions taking place on the catalyst in the fuel cut period and the fuel recovery period and the influences of those reactions on the catalyst temperature $T_{catf}$ will be described.

As in the other operating states, also in the fuel cut period and the fuel recovery period, the rise in catalyst temperature basically depends on heat transfer $\Delta H_t$ between the exhaust gases and the catalyst 9. Thus, the estimation of the catalyst temperature $T_{carf}$ needs to take account of the heat transfer $\Delta H_t$. In the fuel cut period, in addition to the rise in catalyst temperature due to the heat transfer $\Delta H_t$, the catalyst temperature $T_{catf}$ rises due to reaction heat produced when CO and HC that were adsorbed onto the catalyst 9 before the fuel cut (both are unburnt fuel components; Note that in the description below, to represent both of these CO and HC, the term "CO" will be used representatively) are oxidized by $O_2$ in the exhaust gases. Thus, the estimation of the catalyst temperature $T_{carf}$ needs to take account of this oxidation reaction heat $\Delta H_r$.

Meanwhile, in the fuel recovery period, the catalyst temperature $T_{catf}$ rises due to reaction heat produced when CO and HC in the exhaust gases (both are unburnt fuel components; Note that in the description below, to represent both of these CO and HC, the term "CO" will be used representatively) are converted by $O_2$ that was adsorbed onto the catalyst 9 during the fuel cut. Thus, the estimation of the catalyst temperature $T_{carf}$ needs to take account of this conversion reaction heat $\Delta H_c$. Accordingly, as will be described below, in the fuel cut period, the catalyst temperature $T_{catf}$ is estimated taking account of the oxidation reaction heat $\Delta H_r$ in addition to the heat transfer $\Delta H_t$ between the exhaust gases and the catalyst 9, and in the fuel recovery period, the catalyst temperature $T_{catf}$ is estimated taking account of the conversion reaction heat $\Delta H_c$ in addition to the heat transfer $\Delta H_t$.

First, the calculation of the CO oxidation reaction heat $\Delta H_r$ in the fuel cut period will be described.

Figure 2:
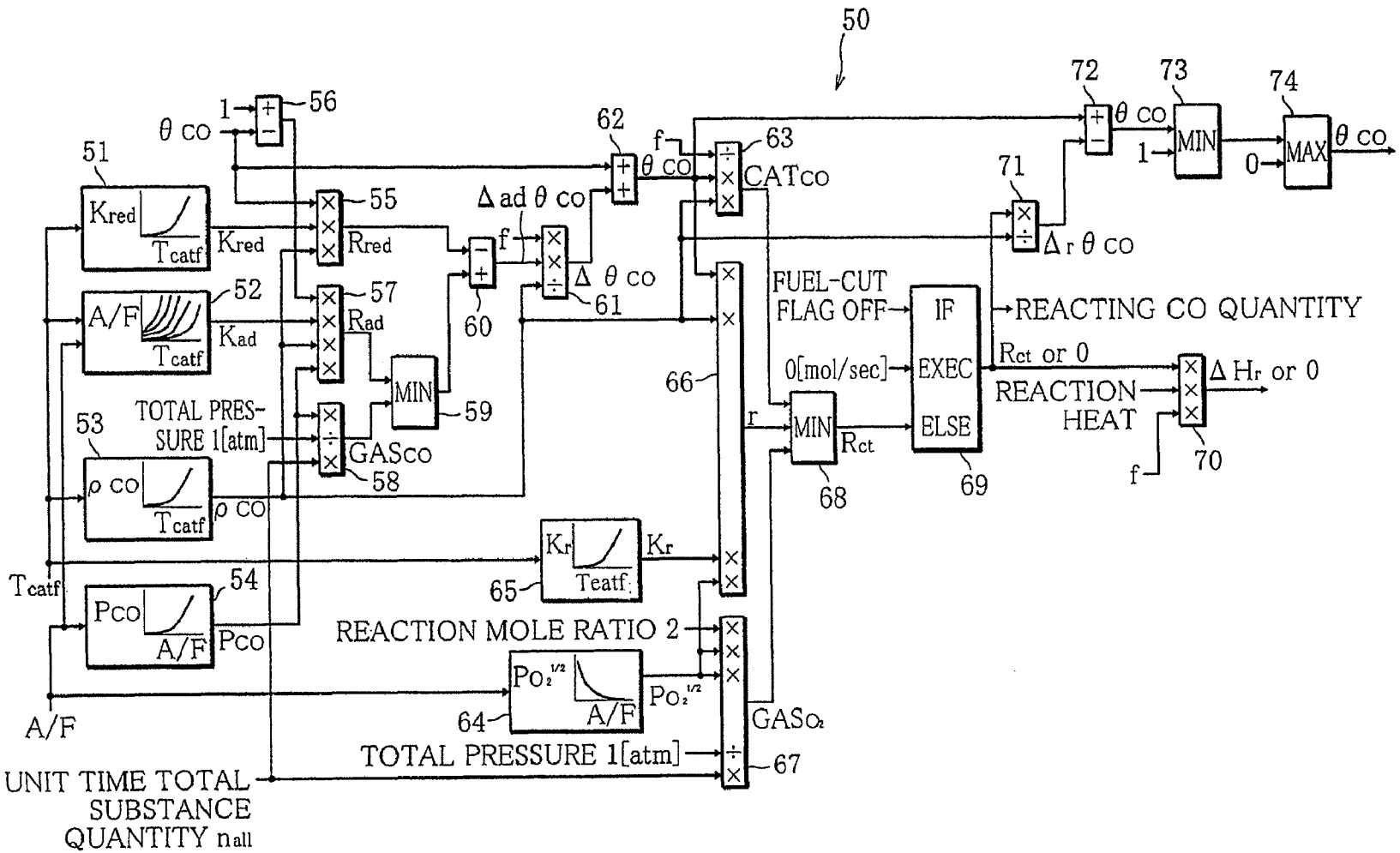
FIG. 2 is a control block diagram showing the processing performed by a fuel-cut-period reaction heat calculation section of an ECU.

FIG. 2 is a control block diagram showing the processing performed by a fuel-cut-period reaction heat calculation section 50 of the ECU 21. In the fuel cut period, a phenomenon that CO is desorbed from the catalyst through reaction with $O_2$ in the exhaust gases and a phenomenon that CO is adsorbed onto the catalyst take place in parallel. Both phenomena together affect the CO adsorption ratio θco of the catalyst 9, and therefore the oxidation reaction heat $\Delta H_r$ in the fuel cut period. Thus, in the calculation of the CO oxidation reaction heat $\Delta H_r$, the adsorbed CO quantity CATco, namely the amount of CO adsorbed on the catalyst 9 is calculated taking account of the desorption of CO from the catalyst and the adsorption of CO onto the catalyst, and the CO oxidation reaction heat $\Delta H_r$ is calculated taking account of this adsorbed CO quantity CATco.

In FIG. 2, a desorption constant calculation section 51 of the fuel-cut-period reaction heat calculation section 50 obtains a desorption rate constant $K_{red}$, referring to a map prepared in advance, on the basis of the catalyst temperature $T_{catf}$ estimated in the last processing cycle. The desorption rate $R_{red}$ at which CO is desorbed from the catalyst varies depending on the activated state of the catalyst 9. Thus, the desorption rate constant $K_{red}$ is determined depending on the catalyst temperature $T_{catf}$ which correlates with the activated state.

An adsorption constant calculation section 52 obtains an adsorption rate constant $K_{ad}$, referring to a map prepared in advance, on the basis of the catalyst temperature $T_{catf}$ and the exhaust air-fuel ratio A/F detected by the air-fuel ratio sensor 10. The adsorption rate $R_{ad}$ at which CO is adsorbed onto the catalyst 9 is affected by not only the activated state of the catalyst 9 but also the composition of the exhaust gases which varies depending on the exhaust air-fuel ratio A/F. Thus, the adsorption rate constant $K_{ad}$ is determined depending on the catalyst temperature $T_{catf}$ and the exhaust air-fuel ratio A/F. It is to be noted that the exhaust air-fuel ratio A/F may be estimated from the engine operating state, etc., according to a known estimation method.

An adsorption sites calculation section 53 obtains the number ρco (mol) of all the adsorption sites of the catalyst 9 capable of adsorbing CO, referring to a map prepared in advance, on the basis of the catalyst temperature $T_{catf}$. The number ρco of the adsorption sites is proper to the catalyst but varies depending on the activated state of the catalyst 9. Thus, the number ρco of the adsorption sites is determined depending on the catalyst temperature $T_{catf}$ which correlates with the activated state.

A CO concentration calculation section 54 determines CO concentration Pco (atm) in the exhaust gases, referring to a map prepared in advance, on the basis of the exhaust air-fuel ratio A/F. Since the CO concentration Pco correlates with the exhaust air-fuel ratio A/F, the CO concentration Pco is determined depending on the exhaust air-fuel ratio A/F.

Meanwhile, in the calculation of the oxidation reaction heat $\Delta H_r$ in the last processing cycle, the CO adsorption ratio θco of the catalyst 9 has been calculated, and between the CO adsorption ratio θco and the number ρco of the adsorption sites, there exists a relationship expressed by the equation (1) below:

$$\theta co = r\rho co / \rho co \quad (1)$$

where rρco is the number of the adsorption sites of the catalyst 9 at which CO is really adsorbed.

The CO adsorption ratio θco, the desorption rate constant $K_{red}$ calculated by the desorption constant calculation section 51, and the number ρco of the adsorption sites calculated by the adsorption sites calculation section 53 are fed to a desorption rate calculation section 55. Using these input values, the desorption rate calculation section 55 calculates the CO desorption rate $R_{red}$ (mol/sec) at which CO is desorbed from the catalyst, according to the equation (2) below (desorption rate calculation element):

$$R_{red} = K_{red} \cdot \rho co \cdot \theta co \quad (2)$$

The CO adsorption ratio θco is also fed to a subtraction section 56, and the subtraction section 56 subtracts the CO adsorption ratio θco from 1 (1−θco). The value obtained by the subtraction section 56, the adsorption rate constant $K_{ad}$ calculated by the adsorption rate constant calculation section 52, the number ρco of the adsorption sites calculated by the adsorption sites calculation section 53, and the CO concentration Pco calculated by the CO concentration calculation section 54 are fed to an adsorption rate calculation section 57, and using these input values, the adsorption rate calculation section 57 calculates the CO adsorption rate $R_{ad}$ (mol/sec) at which CO is adsorbed onto the catalyst, according to the equation (3) below (adsorption rate calculation element):

$$R_{ad}=K_{ad}\cdot\rho co\cdot(1-\theta co)\cdot Pco \quad (3)$$

Further, the CO concentration Pco calculated by the CO concentration calculation section 54, total pressure 1 (atm), and the total substance quantity per unit time $n_{all}$ (mol/sec) of the exhaust gases, namely the amount of all the substances in the exhaust gases in unit time are fed to a partial pressure calculation section 58, and the partial pressure calculation section 58 calculates the exhaust CO quantity GASco (mol/sec), namely the amount of CO in the exhaust gases, in terms of partial pressure, according to the equation (4) below. It is to be noted that the total substance quantity per unit time $n_{all}$ of the exhaust gases is calculated according to a known calculation method, from the intake quantity Q, the amount of air and of fuel in terms of mole, the exhaust air-fuel ratio A/F, etc., of which the detailed explanation will be omitted.

$$GASco=Pco/1\cdot n_{all} \quad (4)$$

The CO adsorption rate $R_{ad}$ on the catalyst and the exhaust CO quantity GASco are fed to a minimum-value selection section 59, and the minimum-value selection section 59 chooses a smaller one of these input values, thereby determining the definitive CO adsorption rate $R_{ad}$ on the catalyst. Specifically, the CO adsorption rate $R_{ad}$ represents the capacity of the catalyst 9 to adsorb CO. When the exhaust CO quantity GASco is greater than or equal to the CO adsorption rate $R_{ad}$, CO is actually adsorbed onto the catalyst at the CO adsorption rate $R_{ad}$. When the exhaust CO quantity GASco is less than the CO adsorption rate $R_{ad}$, the rate at which CO is actually adsorbed onto the catalyst is limited to the exhaust CO quantity GASco. For this reason, the minimum-value selection section 59 chooses a smaller one of the input values.

The CO desorption rate $R_{red}$ calculated by the desorption rate calculation section 55 and the CO adsorption rate $R_{ad}$ on the catalyst definitively determined by the minimum-value selection section 59 are fed to an adsorbed-CO-quantity-per-unit-time calculation section 60, and the adsorbed-CO-quantity-per-unit-time calculation section 60 calculates the adsorbed CO quantity per unit time Δadθco, namely the amount of CO adsorbed onto the catalyst 9 in unit time, according to the equation (5) below:

$$\Delta ad\theta co=R_{ad}-R_{red} \quad (5)$$

The adsorbed CO quantity per unit time Δadθco thus calculated, the number ρco of the adsorption sites of the catalyst 9, and the processing period f of the ECU 21 (0.1 msec, for example) are fed to an adsorption-ratio change calculation section 61, and the adsorption-ratio change calculation section 61 calculates a change Δθco in CO adsorption ratio θco in the processing period f, according to the equation (6) below:

$$\Delta\theta co=\Delta ad\theta co/\rho co\cdot f \quad (6)$$

The change Δθco in CO adsorption ratio θco and the CO adsorption ratio θco are fed to an adsorption ratio calculation section 62, and the adsorption ratio calculation section 62 takes this CO adsorption ratio θco as a value θco(n−1) in the last processing cycle, and calculates the present CO adsorption ratio θco(n), according to the equation (7) below:

$$\theta co(n)=\theta co(n-1)+\Delta\theta co \quad (7)$$

Then, the CO adsorption ratio θco(n), the number ρco of the adsorption sites, and the processing period f of the ECU 21 are fed to an adsorbed CO quantity calculation section 63, and the adsorbed CO quantity calculation section 63 calculates the adsorbed CO quantity per unit time CATco (mol/sec) corresponding to the amount of CO adsorbed on the catalyst 9 at present, according to the equation (9) below (adsorbed unburnt-fuel-component quantity calculation element):

$$CATco=\theta co(n)\cdot\rho co/f \quad (9)$$

Meanwhile, an $O_2$ concentration calculation section 64 obtains $O_2$ concentration $Po_2$, referring to a map prepared in advance, on the basis of the exhaust air-fuel ratio A/F. Like the above-mentioned CO concentration Pco, the $O_2$ concentration $Po_2$ is determined depending on the exhaust air-fuel ratio A/F, but, for the convenience of substitution in the later-mentioned equation (10) representing the reaction rate, the map is prepared to give the square root $Po_2^{1/2}$ of the $O_2$ concentration $Po_2$.

A reaction rate constant calculation section 65 obtains a reaction rate constant $K_r$ for the reaction of CO and $O_2$, referring to a map prepared in advance, on the basis of the catalyst temperature $T_{catf}$. Since the rate of reaction of CO and $O_2$ varies depending on the activated state of the catalyst 9, the reaction rate constant $K_r$ is determined depending on the catalyst temperature $T_{catf}$.

The $O_2$ concentration $Po_2^{1/2}$ calculated by the $O_2$ concentration calculation section 64, the reaction rate constant $K_r$ calculated by the reaction rate constant calculation section 65, the CO adsorption ratio θco and the number ρco of the adsorption sites are fed to a reaction rate calculation section 66, and the reaction rate calculation section 66 calculates the maximum reaction rate r (mol/sec) at which CO and $O_2$ can react, according to the equation (10) below (reaction rate calculation element):

$$r=K_r\cdot\rho co\cdot\theta co(Po_2)^{1/2} \quad (10)$$

Specifically, since the maximum reaction rate r at which CO and $O_2$ react on the catalyst is determined depending on the product of the CO quantity CATco (=ρco·θco) and the $O_2$ concentration $Po_2$, and since the mole ratio of CO to $O_2$ in the reaction is "2" as seen from the equation (11) below, the above equation (10) includes the $O_2$ concentration in the form of square root $PO_2^{1/2}$.

$$CO+1/2O_2\rightarrow CO_2 \quad (11)$$

The reaction mole ratio "2" determined from the equation (11), the $O_2$ concentration $Po_2^{1/2}$ calculated by the $O_2$ concentration calculation section 64, total pressure 1 (atm), and the total substance quantity per unit time $n_{all}$ of the exhaust gases are fed to an exhaust $O_2$ quantity calculation section 67, and the exhaust $O_2$ quantity calculation section 67 calculates the exhaust $O_2$ quantity $GASo_2$ (mol/sec), namely the amount of $O_2$ in the exhaust gases, according to the equation (12) below (exhaust $O_2$ quantity calculation element).

$$GASo_2=2\cdot Po_2/1\cdot n_{all} \quad (12)$$

The adsorbed CO quantity CATco on the catalyst calculated by the adsorbed CO quantity calculation section 63, the reaction rate r calculated by the reaction rate calculation section 66, and the exhaust $O_2$ quantity $GASo_2$ calculated by the exhaust $O_2$ quantity calculation section 67 are fed to a minimum-value selection section 68, and the minimum-value selection section 68 chooses the smallest one of these input values, thereby determining the reacting CO quantity $R_{ct}$, namely the amount of CO taking part in the reaction. While the quantity of CO reacting with $O_2$ is basically determined depending on a smaller one of the adsorbed CO quantity CATco and the exhaust $O_2$ quantity $GASo_2$, the reaction at a rate higher than the reaction rate r is impossible. Thus, the smallest one of the three quantities including the reaction rate r is chosen as the reacting CO quantity $R_{ct}$.

The reacting CO quantity $R_{ct}$ calculated by the minimum-value selection section 68 and the value of a fuel-cut flag, which is at a ON-value while the fuel cut is being performed on the engine 1, are fed to a fuel-cut determination section 69. When determining that the fuel cut is not being performed from the fuel-cut flag reset to an OFF-value, the fuel-cut determination section 69 chooses "0", and when determining that the fuel cut is being performed from the fuel-cut flag set to the ON-value, chooses the reacting CO quantity $R_{ct}$. The value chosen by the fuel-cut determination section 69, reaction heat produced by fuel (283 kJ/mol, for example), and the processing period f of the ECU 21 are fed to a $\Delta H_r$ calculation section 70, and using these input values, the $\Delta H_r$ calculation section 70 calculates the CO oxidation reaction heat $\Delta H_r$ produced by the CO oxidation reaction on the catalyst (oxidation reaction heat calculation element). Thus, while the fuel cut is not being performed, the fuel-cut-period reaction heat calculation section 50 sends out "0", and while the fuel cut is being performed, sends out the CO oxidation reaction heat $\Delta H_r$.

The value ($R_{ct}$ or "0") chosen by the fuel-cut determination section 69 and the number ρco of the adsorption sites are fed to an adsorption-ratio decrease calculation section 71, and using these input values, the adsorption-ratio decrease calculation section 71 calculates a decrease $\Delta_r\theta co$ in adsorption ratio of the catalyst caused by the reaction of CO. The decrease $\Delta_r\theta co$ in adsorption ratio thus calculated and the CO adsorption ratio θco(n) calculated by the adsorption ratio calculation section 62 in the present processing cycle are fed to an adsorption ratio update section 72, and the adsorption ratio update section 72 calculates the latest CO adsorption ratio θco, according to the equation (13) below:

$$\theta co=\theta co(n)-\Delta_r\theta co \tag{13}$$

The CO adsorption ratio θco calculated by the adsorption ratio update section 72 is limited by an upper clipping section 73 to the upper limit 1.0, and limited by a lower clipping section 74 to the lower limit 0. The processing by the clipping sections 73 and 74 is provided for an improper CO adsorption ratio θco which may possibly be produced for some reason. The CO adsorption ratio θco after this processing is used in the next processing cycle of the ECU 21.

Next, the calculation of heat transfer $\Delta H_t$ (kJ/sec) between the exhaust gases and the catalyst 9 will be described.

Figure 3:
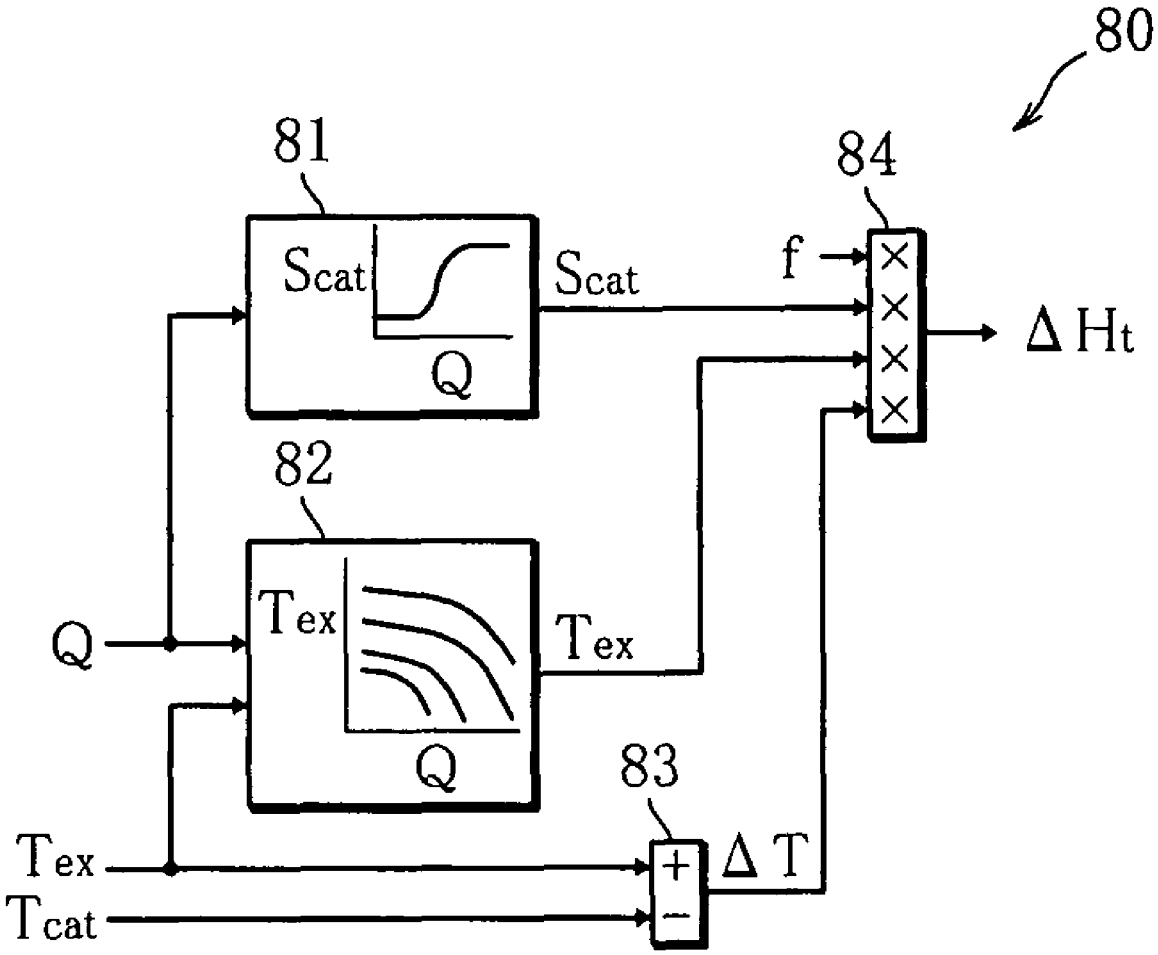
FIG. 3 is a control block diagram showing the processing performed by an exhaust-catalyst heat transfer calculation section of the ECU.

FIG. 3 is a control block diagram showing the processing performed by an exhaust-catalyst heat transfer calculation section 80 of the ECU 21. The heat transfer $\Delta H_t$ between the exhaust gases and the catalyst 9 depends on temperature difference between the exhaust gases and the catalyst 9, contact area between the exhaust gases and the catalyst 9, and a coefficient of heat transfer. Between these quantities, there exists a relationship expressed by the equation (14) below:

$$\Delta H_t=h\cdot S_v\cdot(T_{ex}-T_{catf})\cdot V_{cat} \tag{14}$$

where $S_v$ is the specific surface area of the catalyst 9, h is a coefficient of heat transfer, $T_{ex}$ is the temperature of the exhaust gases obtained by estimation, $T_{catf}$ is the temperature of the catalyst, and $V_{cat}$ is the volume of the catalyst. It is to be noted that although here, the exhaust gas temperature $T_{ex}$ is assumed to be obtained by estimation, it may be detected using an exhaust temperature sensor 11 as shown in FIG. 1.

In FIG. 3, a contact area calculation section 81 of the heat transfer calculation section 80 calculates the effective contact area $S_{cat}$ of the catalyst 9, referring to a map prepared in advance, on the basis of the intake quantity Q. The effective contact area $S_{cat}$ is the area of the catalyst 9 subjected to contact with the exhaust gases, and corresponds to the product of the specific surface area $S_v$ and the volume $V_{cat}$ of the catalyst 9 in the equation (14).

A heat transfer coefficient calculation section 82 calculates a heat transfer coefficient h, referring to a map prepared in advance, on the basis of the intake quantity Q and the exhaust gas temperature $T_{ex}$. A temperature difference calculation section 83 calculates a difference ΔT between the exhaust gas temperature $T_{ex}$ and provisional catalyst temperature $T_{cat}$ (catalyst temperature before subjected to filtering).

The effective contact area $S_{cat}$, the heat transfer coefficient h, the temperature difference ΔT, and the processing period f of the ECU 21 are fed to a $\Delta H_t$ calculation section 84, and using these quantities together, the $\Delta H_t$ calculation section 84 calculates the heat transfer $\Delta H_t$ (kJ/sec), according to the equation (14) (heat transfer calculation element).

Next, the calculation of the CO conversion reaction heat $\Delta H_c$, namely the heat produced by the reaction in which CO is converted by $O_2$ adsorbed on the catalyst 9, in the fuel recovery period.

Figure 4:
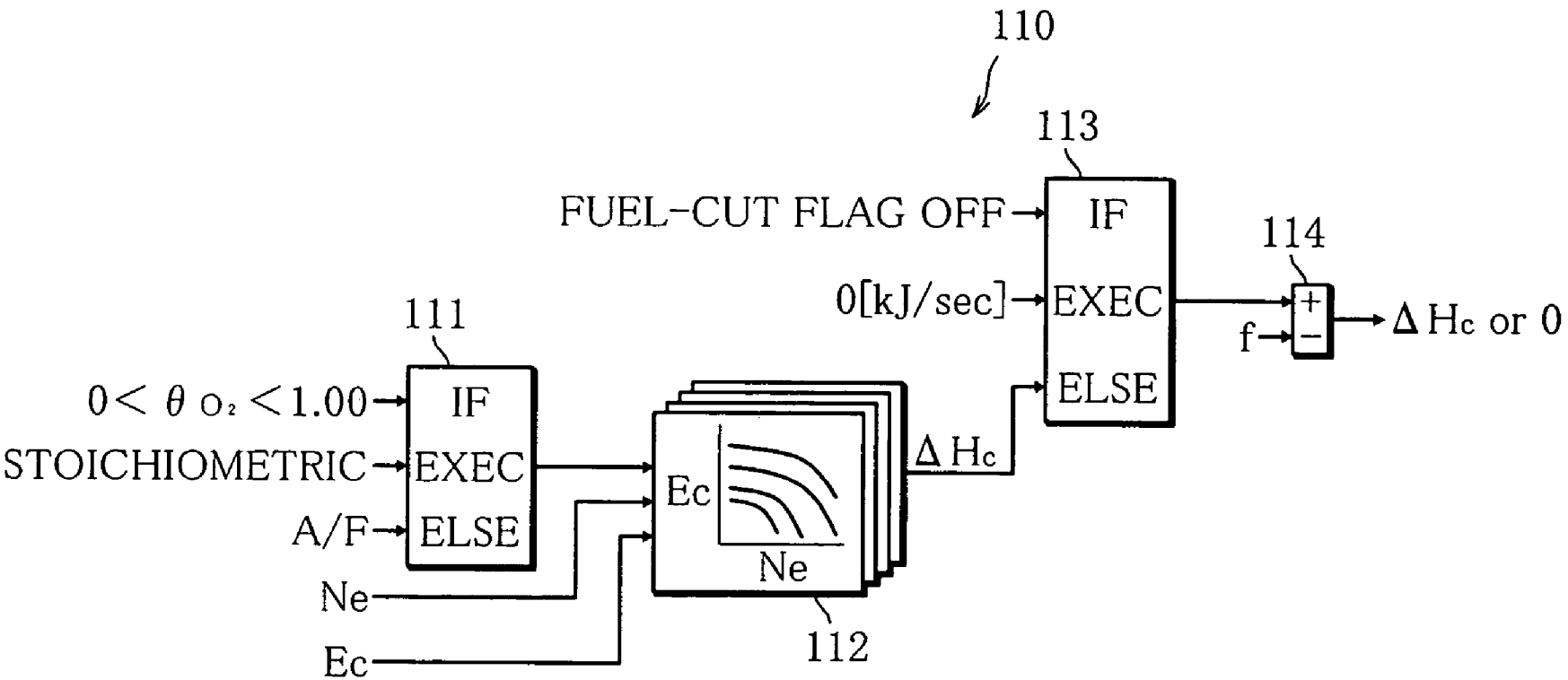
FIG. 4 is a control block diagram showing the processing performed by a fuel-recovery-period conversion heat calculation section of the ECU.
Figure 5:
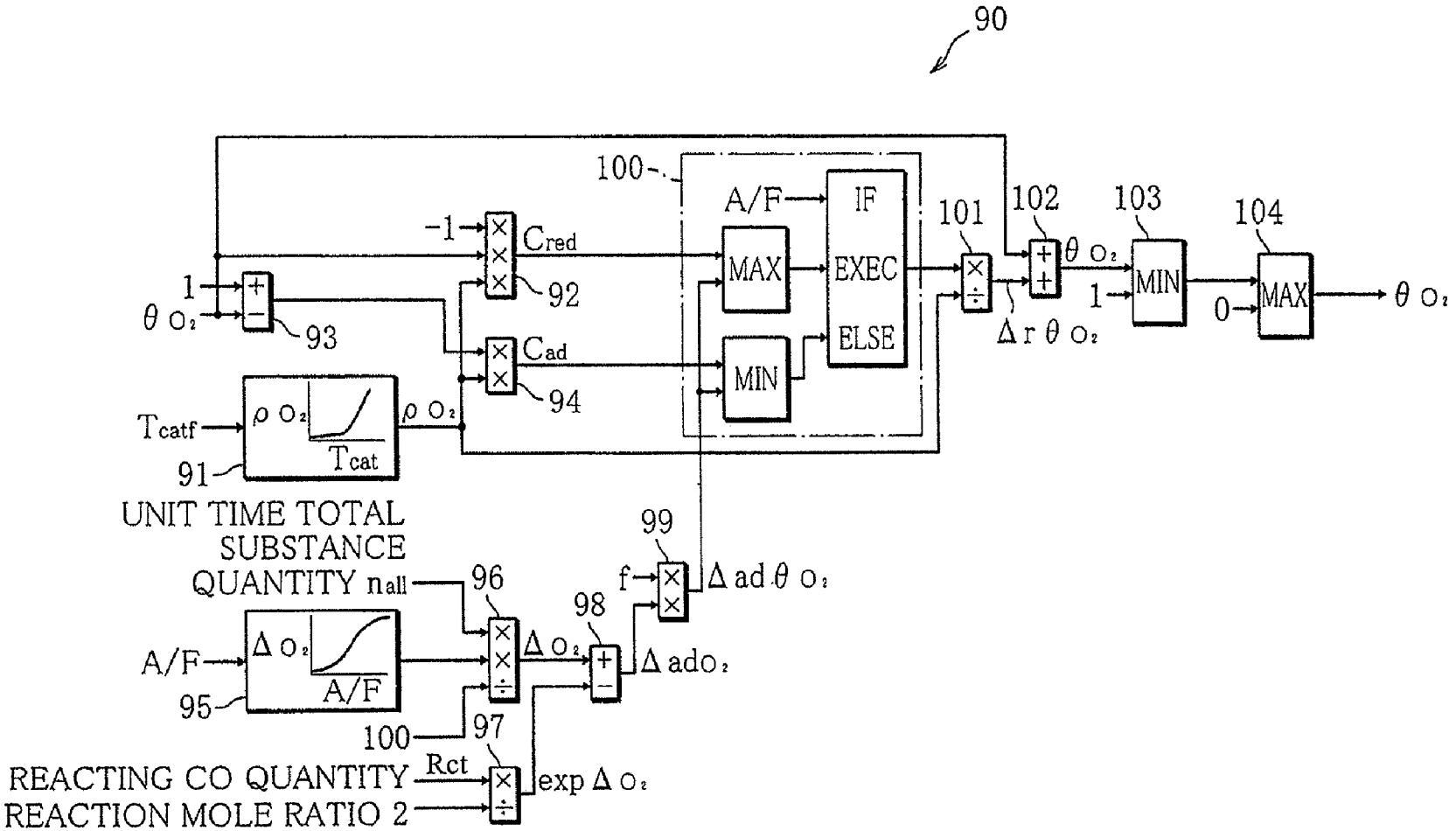
FIG. 5 is a control block diagram showing the processing performed by an $O_2$ adsorption ratio calculation section of the ECU.

FIG. 4 is a control block diagram showing the processing performed by a fuel-recovery-period conversion heat calculation section 110 of the ECU 21, and FIG. 5 is a control block diagram showing the processing performed by an $O_2$ adsorption ratio calculation section 90 of the ECU 21. The CO conversion reaction heat $\Delta H_c$, namely the heat produced by the conversion of CO on the catalyst depends on the operating state of the engine 1, specifically, engine revolving rate Ne, charging efficiency Ec, and air-fuel ratio on the catalyst, and can be determined from these quantities. For the air-fuel ratio on the catalyst, basically the exhaust air-fuel ratio A/F can be used, while the air-fuel ratio on the catalyst is affected by the $O_2$ storage function of the catalyst 9, which needs consideration. Specifically, the catalyst 9 has a function of maintaining the exhaust air-fuel ratio A/F at the stoichiometric air-fuel ratio (=14.7), by adsorbing $O_2$ at lean exhaust air-fuel ratios and desorbing $O_2$ at rich exhaust air-fuel ratios. Thus, when the catalyst is exhibiting this $O_2$ storage function, the air-fuel ratio on the catalyst is maintained at the stoichiometric, although the exhaust air-fuel ratio A/F is not the stoichiometric. Meanwhile, when the catalyst is not exhibiting the $O_2$ storage function, the air-fuel ratio on the catalyst equals the exhaust air-fuel ratio A/F.

Thus, in the calculation of the CO conversion reaction heat $\Delta H_c$, the $O_2$ adsorption ratio $\theta o_2$ which correlates with the $O_2$ storage function of the catalyst 9 is calculated, and the calculated $O_2$ adsorption ratio $\theta o_2$ is used to calculate the CO conversion reaction heat $\Delta H_c$ (kJ/sec). First, the calculation of the $O_2$ adsorption ratio $\theta o_2$ will be described.

Like the behavior of CO on the catalyst in the fuel cut period, in the fuel recovery period, a phenomenon that $O_2$ is desorbed from the catalyst through reaction with CO in the exhaust gases and a phenomenon that $O_2$ in the exhaust gases is adsorbed onto the catalyst take place in parallel. Both phenomena together affect the $O_2$ adsorption ratio $\theta o_2$ of the catalyst 9, and therefore the CO conversion reaction heat $\Delta H_c$ in the fuel recovery period. Thus, in the calculation of the CO conversion reaction heat $\Delta H_c$, the adsorbed $O_2$ quantity, namely the amount of $O_2$ adsorbed on the catalyst 9 is calculated taking account of the desorption of $O_2$ from the catalyst and the adsorption of $O_2$ onto the catalyst, and the CO conversion reaction heat $\Delta H_c$ is calculated taking account of this adsorbed $O_2$ quantity.

In FIG. 5, an adsorption sites calculation section 91 of an $O_2$ adsorption ratio calculation section 90 obtains the number $\rho o_2$ (mol) of all the adsorption sites of the catalyst 9 capable of adsorbing $O_2$, referring to a map prepared in advance, on the basis of the catalyst temperature $T_{catf}$. As in the case of the CO adsorption sites, the number $\rho o_2$ of the adsorption sites is proper to the catalyst but varies depending on the activated state of the catalyst 9. Thus, the number $\rho o_2$ of the adsorption sites is determined depending on the catalyst temperature $T_{catf}$ which correlates with the activated state. Between the number $\rho o_2$ of the adsorption sites and the $O_2$ adsorption ratio $\theta o_2$, there exists a relationship expressed by the equation (15) below:

$$\theta o_2 = r\rho o_2/\rho o_2 \tag{15}$$

where $r\rho o_2$ is the number of the adsorption sites of the catalyst 9 at which $O_2$ is really adsorbed.

The number $\rho o_2$ of the adsorption sites calculated by the adsorption sites calculation section 91 and the $O_2$ adsorption ratio $\theta o_2$ in the last processing cycle are fed to an $O_2$ desorption capacity calculation section 92, and using these input values, the $O_2$ desorption capacity calculation section 92 calculates the present $O_2$ desorption capacity $C_{red}$ (mol) of the catalyst 9, according to the equation (16) below:

$$C_{red} = \rho o_2 \cdot \theta o_2 \cdot (-1) \tag{16}$$

It is to be noted that in the equation (16), the $O_2$ desorption capacity $C_{red}$ is obtained as a negative value by multiplying −1, considering that the desorption of $O_2$ decreases the $O_2$ adsorption ratio $\theta o_2$.

A subtraction section 93 subtracts the $O_2$ adsorption ratio $\theta o_2$ from 1 $(1-\theta o_2)$. The value obtained by the subtraction and the number $\rho o_2$ of the adsorption sites calculated by the adsorption sites calculation section 91 are fed to an $O_2$ adsorption capacity calculation section 94, and using these input values, the $O_2$ adsorption capacity calculation section 94 calculates the present $O_2$ adsorption capacity $C_{ad}$(mol) of the catalyst 9, according to the equation (17) below:

$$C_{ad} = \rho o_2 \cdot (1-\theta o_2) \tag{17}$$

Meanwhile, an $O_2$ excess/deficiency calculation section 95 obtains $O_2$ excess/deficiency $\Delta O_2$ (vol %) in the exhaust gases, referring to a map prepared in advance, on the basis of the exhaust air-fuel ratio A/F. The $O_2$ excess/deficiency $\Delta O_2$ means the amount by which $O_2$ exceeds or falls below the stoichiometric quantity, and is determined depending on the exhaust air-fuel ratio A/F. The $O_2$ excess/deficiency $\Delta O_2$ thus obtained and the total substance quantity per unit time nail (mol/sec) of the exhaust gases are fed to a conversion section 96, and the conversion section 96 converts the $O_2$ excess/deficiency $\Delta O_2$ to the quantity per unit time (mol/sec).

To an $O_2$ expenditure calculation section 97, the reacting CO quantity $R_{ct}$ (mol/sec) from the fuel-cut determination section 69 of the fuel-cut-period reaction heat calculation section 50 and the mole ratio "2" between CO and $O_2$ in the reaction are fed, and using these input values, the $O_2$ expenditure calculation section 97 calculates the $O_2$ expenditure $\exp\Delta O_2$ in the exhaust gases, namely the amount of $O_2$ in the exhaust gases which was consumed in the reaction with CO on the catalyst during the fuel cut, according to the equation (18) below:

$$\exp\Delta O_2 = R_{ct}/2 \tag{18}$$

To a subtraction section 98, the $O_2$ excess/deficiency $\Delta O_2$ after the conversion by the conversion section 96, and the $O_2$ expenditure $\exp\Delta O_2$ calculated by the $O_2$ expenditure calculation section 97 are fed, and the subtraction section 98 calculates the stoichometric required $O_2$ quantity $\Delta ado_2$, which means the amount per unit time of $O_2$ required to make the composition of the exhaust gases stoichiometric (or in other words, to completely convert CO in the exhaust gases), according to the equation (19) below. Specifically, when the exhaust air-fuel ratio A/F is rich so that CO in the exhaust gases needs to be oxidized by $O_2$, the stoichometric required $O_2$ quantity $\Delta ado_2$ to be calculated is the amount of $O_2$ which needs to be desorbed from the catalyst (negative value), and when the exhaust air-fuel ratio A/F is lean so that excess $O_2$ needs to be adsorbed, the stoichometric required $O_2$ quantity $\Delta ado_2$ to be calculated is the amount of $O_2$ which needs to be adsorbed onto the catalyst (positive value). The stoichometric required $O_2$ quantity $\Delta ado_2$ thus calculated is fed to a conversion section 99 and converted to the quantity $\Delta ad\theta o_2$ in the processing period f, according to the equation (20) below.

$$\Delta ado_2 = \Delta O_2 - \exp\Delta O_2 \tag{19}$$

$$\Delta ad\theta o_2 = \Delta ado_2 \cdot f \tag{20}$$

The stoichometric required $O_2$ quantity $\Delta ad\theta o_2$ after the conversion, the $O_2$ desorption capacity $C_{red}$ and the $O_2$ adsorption capacity $C_{ad}$ of the catalyst 9, and the exhaust air-fuel ratio A/F are fed to an $O_2$ desorption/adsorption quantity calculation section 100. When the exhaust air-fuel ratio is rich, namely richer than the stoichiometric air-fuel ratio, so that it is inferred that $O_2$ is being desorbed from the catalyst, the $O_2$ desorption/adsorption quantity calculation section 100 chooses a greater quantity between the $O_2$ desorption capacity $C_{red}$ and the stoichometric required $O_2$ quantity $\Delta ad\theta o_2$ (namely, the quantity having a smaller absolute value, since both quantities are negative). When the exhaust air-fuel ratio A/F is lean, namely leaner than the stoichiometric air-fuel ratio, so that it is inferred that $O_2$ is being adsorbed onto the catalyst, the $O_2$ desorption/adsorption quantity calculation section 100 chooses a smaller quantity between the $O_2$ adsorption capacity $C_{ad}$ and the stoichometric required $O_2$ quantity $\Delta ad\theta o_2$.

Specifically, when the $O_2$ quantity required to make the composition of the exhaust gases stoichiometric ($\Delta ad\theta o_2$) exceeds the capacity ($C_{red}$, $C_{ad}$) of the catalyst, the amount of $O_2$ actually used is limited to the capacity of the catalyst. Meanwhile, when the capacity ($C_{red}$, $C_{ad}$) of the catalyst exceeds the $O_2$ quantity required to make the composition of the exhaust gases stoichiometric ($\Delta ad\theta o_2$), the amount of $O_2$ actually used is the required $O_2$ quantity. The processing of the $O_2$ desorption/adsorption quantity calculation section 100 is provided in view of this.

The value chosen by the $O_2$ desorption/adsorption quantity calculation section 100 ($C_{red}$ or $C_{ad}$ or $\Delta ad\theta o_2$) and the number $\rho o_2$ of the adsorption sites are fed to an adsorption-ratio decrease calculation section 101, and using these input values, the adsorption-ratio decrease calculation section 101 calculates a decrease $\Delta r\theta o_2$ in adsorption ratio of the catalyst caused by the reaction of $O_2$. The decrease $\Delta r\theta o_2$ in adsorption ratio thus calculated and the $O_2$ adsorption ratio $\theta o_2$ in the last processing cycle are fed to an adsorption ratio update section 102, and the adsorption ratio update section 102 calculates the latest $O_2$ adsorption ratio $\theta O_2$ according to the equation (21) below ($O_2$ storage index calculation element)

$$\theta O_2 = \theta O_2 + \Delta r\theta o_2 \tag{21}$$

The $O_2$ adsorption ratio $\theta O_2$ calculated by the adsorption ratio update section 102 is limited by an upper clipping section 103 to the upper limit 1.0, and limited by a lower clipping section 104 to the lower limit 0.

The $O_2$ adsorption ratio $\theta O_2$ of the catalyst 9 calculated in the above-described manner is fed to an air-fuel ratio determination section 111 of the fuel-recovery-period conversion heat calculation section 110 shown in FIG. 4. When determining that the catalyst 9 is not exhibiting the $O_2$ storage function from the $O_2$ adsorption ratio $\theta O_2$ being 0 ($O_2$ desorption limit) or 1.0 ($O_2$ adsorption limit), the air-fuel ratio determination section 111 chooses the exhaust air-fuel ratio A/F for the air-fuel ratio on the catalyst (air-fuel ratio estimation element). When determining that the catalyst 9 is exhibiting the $O_2$ storage function from the $O_2$ adsorption ratio $\theta O_2$ satisfying the condition $0<\theta o_2<1.0$, the air-fuel ratio determination section 111 chooses the stoichometric air-fuel ratio for the air-fuel ratio on the catalyst (air-fuel ratio estimation element).

The air-fuel ratio on the catalyst determined by the air-fuel ratio determination section 111, the engine revolving rate Ne detected by the revolving rate sensor 23 (operating state detection element) and the charging efficiency Ec calculated on the basis of the operating state of the engine 1 (operating state detection element) are fed to a $\Delta H_c$ calculation section 112, and the $\Delta H_c$ calculation section 112 calculates the CO conversion reaction heat per unit time $\Delta H_c$ (kJ/sec), referring to a map prepared in advance, on the basis of the engine revolving rate Ne, the charging efficiency Ec and the air-fuel ratio on the catalyst (conversion reaction heat calculation element).

The CO conversion reaction heat $\Delta H_c$ thus calculated and the value of the fuel-cut flag are fed to a fuel-cut determination section 113. When determining that the fuel cut is not being performed from the fuel-cut flag reset to the OFF-value, the fuel-cut determination section 113 chooses the CO conversion reaction heat $\Delta H_c$, and when determining that the fuel cut is being performed from the fuel-cut flag set to the ON-value, the fuel-cut determination section 113 chooses "0". The value chosen by the fuel-cut determination section 113 and the processing period f of the ECU 21 are fed to a period conversion section 114, and using these input values, the period conversion section 114 calculates the CO conversion reaction heat $\Delta H_c$ (kJ) in the processing period f. Thus, while the fuel cut is not being performed, the fuel-recovery-period conversion heat calculation section 110 sends out the CO conversion reaction heat $\Delta H_c$, and while the fuel cut is being performed, sends out "0".

Next, the estimation of the definitive catalyst temperature $T_{catf}$ will be described.

Figure 6:
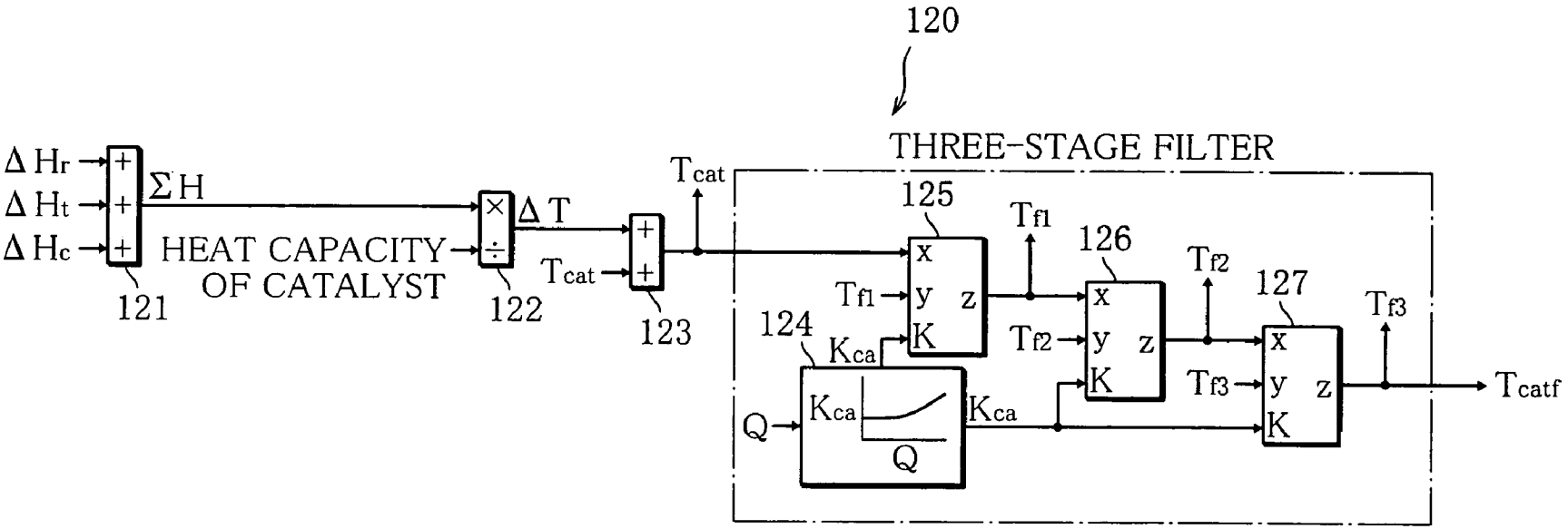

FIG. 6 is a control block diagram showing how the processing by a catalyst temperature estimation section 120 of the ECU 21 goes on. The CO oxidation reaction heat $\Delta H_r$ in the fuel cut period calculated by the fuel-cut-period reaction heat calculation section 50, the CO conversion reaction heat $\Delta H_c$ in the fuel recovery period calculated by the fuel-recovery-period reaction heat calculation section 110, the heat transfer $\Delta H_t$ between the exhaust gases and the catalyst calculated by the heat transfer calculation section 80 are fed to a total heat calculation section 121. As stated above, in the fuel cut period, the CO oxidation reaction heat $\Delta H_r$ and the exhaust-catalyst heat transfer $\Delta H_t$ are calculated as effective values, while in the fuel recovery period, the CO conversion reaction heat $\Delta H_c$ and the exhaust-catalyst heat transfer $\Delta H_t$ are calculated as effective values. Thus, in either case, the total heat calculation section 121 sums the two effective values, thereby obtaining total heat $\Sigma H$ that causes a rise in catalyst temperature.

The total heat $\Sigma H$ thus calculated is fed to a temperature rise calculation section 122, which calculates a temperature rise $\Delta T$ of the catalyst 9 from the total heat $\Sigma H$ and the heat capacity of the catalyst 9 set in advance, and feeds it to a catalyst temperature calculation section 123. The catalyst temperature calculation section 123 calculates provisional catalyst temperature $T_{cat}$ in the present processing cycle, by adding the temperature rise $\Delta T$ to the provisional catalyst temperature $T_{cat}$ (catalyst temperature before subjected to the filtering described below) in the last processing cycle. The provisional catalyst temperature $T_{cat}$ thus calculated is stored for use as a previous value in the next processing cycle, and on the basis of this provisional catalyst temperature $T_{cat}$, definitive catalyst temperature $T_{catf}$ is calculated by a three-stage filter simulating thermal conduction in the catalyst (catalyst temperature estimation element).

A gain calculation section 124 of the three-stage filter sets a filter gain $K_{ca}$, referring to a map prepared in advance, on the basis of the intake quantity Q. As shown in FIG. 6, filter gain $K_{ca}$ increases with intake quantity Q. The filter gain $K_{ca}$ thus set and the provisional catalyst temperature $T_{cat}$ are fed to a first filter section 125. On the basis of the provisional catalyst temperature $T_{cat}$, the filter gain $K_{ca}$, and first catalyst temperature cell $T_{f1}$ (catalyst temperature after first filtering) in the last processing cycle, the first filter section 125 calculates first catalyst temperature cell $T_{f1}$ in the present processing cycle, and the first catalyst temperature cell $T_{f1}$ thus calculated is stored and also sent to a second filter section 126.

The second filter section 126 calculates second catalyst temperature cell $T_{f2}$ in the present processing cycle, on the basis of the first catalyst temperature cell $T_{f1}$, the filter gain $K_{ca}$, and second catalyst temperature cell $T_{f2}$ (catalyst temperature after second filtering) in the last processing cycle, and the second catalyst temperature cell $T_{f2}$ thus calculated is stored and also sent to a third filter section 127.

The third filter section 127 calculates third catalyst temperature cell $T_{f3}$ in the present processing cycle, on the basis of the second catalyst temperature cell $T_{f2}$, the filter gain $K_{ca}$, and third catalyst temperature cell $T_{f3}$ (catalyst temperature after third filtering) in the last processing cycle, and the third catalyst temperature cell $T_{f3}$ thus calculated is stored and also sent out as the definitive catalyst temperature $T_{catf}$. When the intake quantity Q is greater and therefore the filter gain $K_{ca}$ is greater, the filter sections 125 to 127 each produces an output value less affected by a previous value and more affected by a current value. Consequently, the definitive catalyst temperature $T_{catf}$ taking account of the thermal conduction in the catalyst which correlates with the intake quantity Q is calculated.

As explained above, the present embodiment of the catalyst temperature estimation device calculates, in the fuel cut period, the CO oxidation reaction heat $\Delta H_r$ produced when CO adsorbed on the catalyst in the quantity CATco reacts with $O_2$ existing in the exhaust gases in the quantity $GASo_2$, and estimates the temperature of the catalyst of the underfloor catalytic converter 9 on the basis of this CO oxidation reaction heat $\Delta H_r$ and the exhaust-catalyst heat transfer $\Delta H_t$. Meanwhile, in the fuel recovery period, it calculates the CO conversion reaction heat $\Delta H_c$ produced when CO in the exhaust gases is converted by $O_2$ adsorbed on the catalyst, and estimates the temperature of the catalyst of the underfloor catalytic converter 9 on the basis of this CO conversion reaction heat $\Delta H_c$ and the heat transfer $\Delta H_t$. Thus, in either of the fuel cut period and the fuel recovery period, the movements of the catalyst temperature $T_{catf}$ can be estimated accurately. By appropriately performing engine control on the basis of this catalyst temperature $T_{catf}$, the catalytic converter 9 can be prevented from being damaged by a temperature rise beyond the allowable temperature limit.

Figure 7:
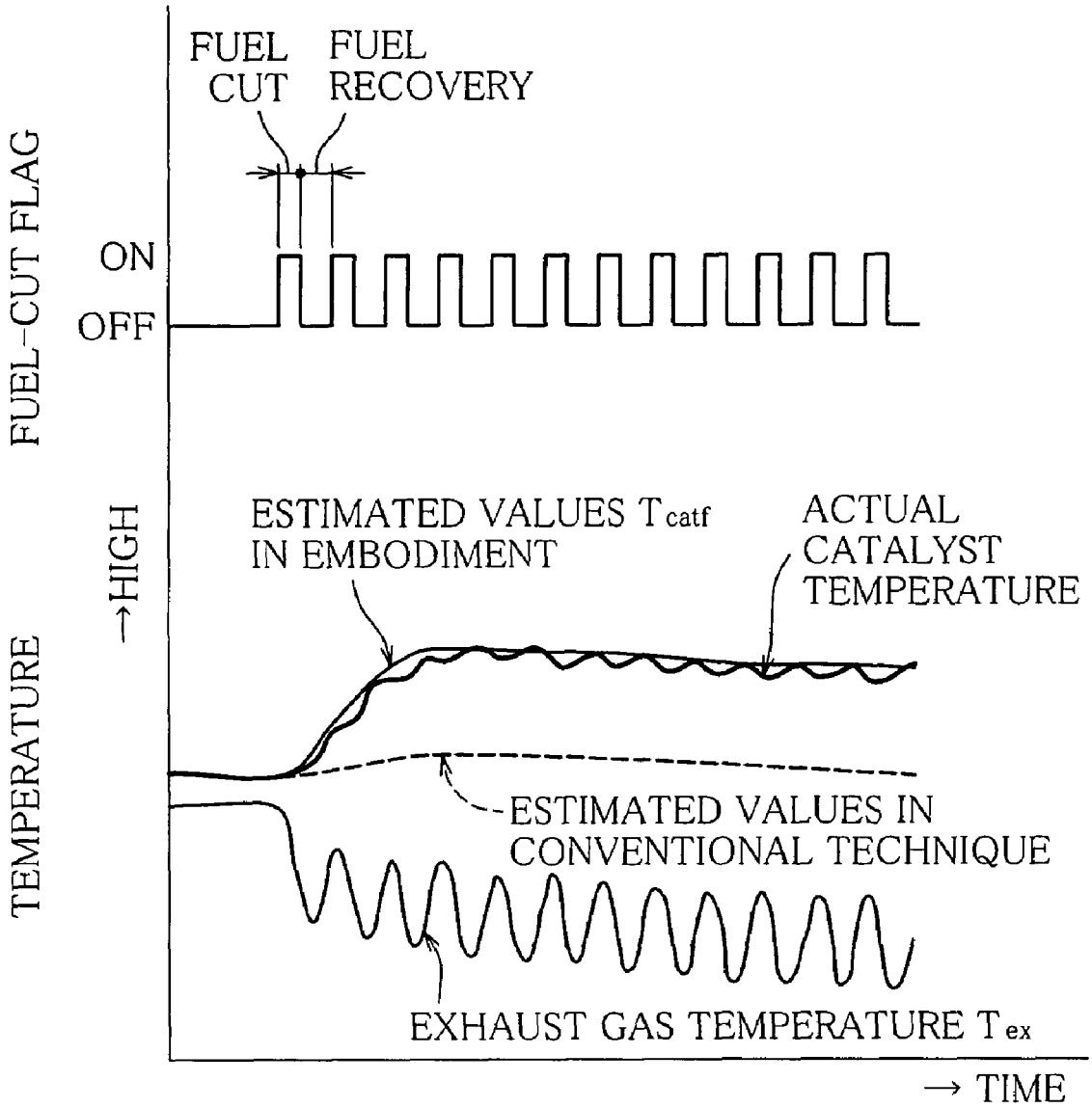
FIG. 7 shows a test result showing how the catalyst temperature is estimated when the fuel cut and fuel recovery is repeated with a short period.

FIG. 7 is a test result showing how the catalyst temperature is estimated by the present invention and by the conventional technique, when the fuel cut and fuel recovery is repeated with a short period. Such operating state can be produced when the driver repeats activation and deactivation of the accelerator frequently. Due to the CO oxidation reaction heat $\Delta H_r$ produced in the fuel cut period and the CO conversion reaction heat $\Delta H_c$ produced in the fuel recovery period, the actual catalyst temperature rises rapidly compared with the exhaust gas temperature $T_{ex}$. The values estimated by the conventional technique hardly reflect this temperature rise. Meanwhile, by the estimation method of the present embodiment, estimated values $T_{catf}$ extremely close to the actual catalyst temperature are obtained. This test result confirms the positive effects of the present invention.

Further, the present embodiment of the catalyst temperature estimation device calculates the amount CATco of CO adsorbed on the catalyst 9 at present, on the basis of the CO desorption rate $R_{red}$ at which CO is desorbed from the catalyst and the CO adsorption rate $R_{ad}$ at which CO is adsorbed onto the catalyst, which rates are obtained according to the actual process. In addition, when the amount GASco of CO in the exhaust gases is less than the CO adsorption rate $R_{ad}$ on the catalyst so that the CO adsorption rate $R_{ad}$ is limited to the CO quantity GASco, the CO quantity GASco is chosen for the CO adsorption rate $R_{ad}$. This allows the adsorbed CO quantity CATco and therefore the CO oxidation reaction heat $\Delta H_r$ to be calculated with improved accuracy.

Further, the calculation of the CO oxidation reaction heat $\Delta H_r$ takes account of not only the amount CATco of CO adsorbed on the catalyst and the amount $GASo_2$ of $O_2$ in the exhaust gases, but also the rate r of reaction of CO and $O_2$. This allows the CO oxidation reaction heat $\Delta H_r$ to be calculated with more improved accuracy.

In the above, an embodiment of the present invention has been described. The present invention is, however, not limited to the described embodiment. For example, although in the above embodiment, the catalyst temperature $T_{carf}$ is estimated in both the fuel cut period and the fuel recovery period, the estimation of the catalyst temperature $T_{carf}$ in the fuel recovery period is not indispensable. For example, the embodiment may be modified to estimate the catalyst temperature $T_{carf}$ only in the fuel cut period, on the basis the CO oxidation reaction heat $\Delta H_r$. Further, although in the described embodiment, the engine 1 is a direct-injection spark-ignition four-cylinder-in-line gasoline engine, the present invention is not limited to this type of engine; the present invention is applicable to that type of gasoline engine in which fuel is supplied to the intake ports, and also to the diesel engine.

What is claimed is:

1. A catalyst temperature estimation device, comprising:

a catalytic converter carrying a catalyst disposed in an exhaust passage of an engine for converting exhaust gases to less harmful substances;

an adsorbed unburnt-fuel-component quantity calculation element for calculating the amount of an unburnt fuel component adsorbed on the catalyst in a fuel cut period of the engine based on a number of all adsorption sites, which is determined depending on an activated state of the catalytic converter capable of adsorbing the unburnt fuel component;

an exhaust $O_2$ quantity calculation element for calculating the amount of $O_2$ in the exhaust gases in the fuel cut period;

an oxidation reaction heat calculation element for calculating reaction heat produced when the adsorbed unburnt fuel component in the amount calculated by the adsorbed unburnt-fuel-component quantity calculation element reacts with $O_2$ in the exhaust gases in the amount calculated by the exhaust $O_2$ quantity calculation element; and a catalyst temperature estimation element for estimating the temperature of the catalyst in the fuel cut period, on the basis of the reaction heat calculated by the oxidation reaction heat calculation element.

2. The catalyst temperature estimation device according to claim 1, further comprising:

a heat transfer calculation element for calculating heat transfer between the exhaust gases from the engine and the catalyst in the fuel cut period, wherein the catalyst temperature estimation element estimates the temperature of the catalyst from the heat transfer calculated by the heat transfer calculation element and the reaction heat calculated by the heat transfer calculation element.

3. The catalyst temperature estimation device according to claim 1, further comprising:

a reaction rate calculation element for calculating the reaction rate at which the unburnt fuel component on the catalyst reacts with $O_2$ in the exhaust gases, on the basis of the activated state of the catalyst, wherein the oxidation reaction heat calculation element calculates the reaction heat on the basis of the smallest one of the amount of the unburnt fuel component adsorbed, the amount of $O_2$ in the exhaust gases, and the reaction rate calculated.

4. The catalyst temperature estimation device according to claim 1, wherein the catalyst temperature estimation element corrects the estimated temperature of the catalyst, by means of a three-stage filter simulating thermal conduction in the catalyst.

5. The catalyst temperature estimation device according to claim 1, further comprising:

an operating state detection element for detecting the operating state of the engine;

an $O_2$ storage index calculation element for calculating an $O_2$ storage index correlating with the amount of $O_2$ adsorbed on the catalyst;

an air-fuel ratio estimation element for estimating air-fuel ratio on the catalyst; and a conversion reaction heat calculation element for calculating reaction heat produced by a conversion reaction on the catalyst in a fuel recovery period of the engine, on the basis of the operating state of the engine detected by the operating state detection element, the $O_2$ storage index calculated by the $O_2$ storage index calculation element, and the air-fuel ratio estimated by the air-fuel ratio estimation element, wherein the catalyst temperature estimation element estimates the temperature of the catalyst in the fuel cut period on the basis of the reaction heat calculated by the oxidation reaction heat calculation element, and in the fuel recovery period on the basis of the reaction heat calculated by the conversion reaction heat calculation element.

6. The catalyst temperature estimation device according to claim 5, wherein when, from the $O_2$ storage index calculated by the $O_2$ storage index calculation element, determining that the catalyst is at a level close to the upper or lower limit of $O_2$ adsorption, the air-fuel ratio estimation element determines that the air-fuel ratio on the catalyst equals the exhaust air-fuel ratio detected by an exhaust air-fuel ratio detection element, and when determining that the catalyst is not at a level close to the upper or lower limit of adsorption, determines that the air-fuel ratio on the catalyst is the stoichiometric air-fuel ratio.

7. The catalyst temperature estimation device according to claim 1, further comprising:

an adsorption rate calculation element for calculating the adsorption rate at which the unburnt fuel component is adsorbed onto the catalyst in the fuel cut period; and a desorption rate calculation element for calculating the desorption rate at which the unburnt fuel component is desorbed from the catalyst in the fuel cut period, wherein the adsorbed unburnt-fuel-component quantity calculation element calculates the amount of the unburnt fuel component adsorbed on the catalyst, on the basis of the adsorption rate calculated by the adsorption rate calculation element and the desorption rate calculated by the desorption rate calculation element.

8. The catalyst temperature estimation device according to claim 7, wherein when the amount of the unburnt fuel component in the exhaust gases is less than the calculated adsorption rate of the unburnt fuel component, the adsorption rate calculation element determines that the adsorption rate equals the amount of the unburnt fuel component in the exhaust gases.

9. A catalyst temperature estimation device, comprising:

a catalytic converter carrying a catalyst disposed in an exhaust passage of an engine for converting exhaust gases to less harmful substances;

an adsorbed unburnt-fuel-component quantity calculation element for calculating the amount of an unburnt fuel component adsorbed on the catalyst in a fuel cut period of the engine;

an exhaust $O_2$ quantity calculation element for calculating the amount of $O_2$ in the exhaust gases in the fuel cut period;

an oxidation reaction heat calculation element for calculating reaction heat produced when the adsorbed unburnt fuel component in the amount calculated by the adsorbed unburnt-fuel-component quantity calculation element reacts with $O_2$ in the exhaust gases in the amount calculated by the exhaust $O_2$ quantity calculation element;

a catalyst temperature estimation element for estimating the temperature of the catalyst in the fuel cut period, on the basis of the reaction heat calculated by the oxidation reaction heat calculation element;

an operating state detection element for detecting the operating state of the engine;

an $O_2$ storage index calculation element for calculating an $O_2$ storage index correlating with the amount of $O_2$ adsorbed on the catalyst;

an air-fuel ratio estimation element for estimating air-fuel ratio on the catalyst; and a conversion reaction heat calculation element for calculating reaction heat produced by a conversion reaction on the catalyst in a fuel recovery period of the engine, on the basis of the operating state of the engine detected by the operating state detection element, the $O_2$ storage index calculated by the $O_2$ storage index calculation element, and the air-fuel ratio estimated by the air-fuel ratio estimation element, wherein the catalyst temperature estimation element estimates the temperature of the catalyst in the fuel cut period on the basis of the reaction heat calculated by the oxidation reaction heat calculation element, and in the fuel recovery period on the basis of the reaction heat calculated by the conversion reaction heat calculation element wherein, when, from the $O_2$ storage index calculated by the $O_2$ storage index calculation element, determining that the catalyst is at a level close to the upper or lower limit of $O_2$ adsorption, the air-fuel ratio estimation element determines that the air-fuel ratio on the catalyst equals the exhaust air-fuel ratio detected by an exhaust air-fuel ratio detection element, and when determining that the catalyst is not at a level close to the upper or lower limit of adsorption, determines that the air-fuel ratio on the catalyst is the stoichiometric air-fuel ratio.

10. A catalyst temperature estimation device, comprising:

a catalytic converter carrying a catalyst disposed in an exhaust passage of an engine for converting exhaust gases to less harmful substances;

an adsorbed unburnt-fuel-component quantity calculation element for calculating the amount of an unburnt fuel component adsorbed on the catalyst in a fuel cut period of the engine;

an exhaust $O_2$ quantity calculation element for calculating the amount of $O_2$ in the exhaust gases in the fuel cut period;

an oxidation reaction heat calculation element for calculating reaction heat produced when the adsorbed unburnt fuel component in the amount calculated by the adsorbed unburnt-fuel-component quantity calculation element reacts with $O_2$ in the exhaust gases in the amount calculated by the exhaust $O_2$ quantity calculation element;

a catalyst temperature estimation element for estimating the temperature of the catalyst in the fuel cut period, on the basis of the reaction heat calculated by the oxidation reaction heat calculation element; and a reaction rate calculation element for calculating the reaction rate at which the unburnt fuel component on the catalyst reacts with $O_2$ in the exhaust gases, on the basis of the activated state of the catalyst, wherein the oxidation reaction heat calculation element calculates the reaction heat on the basis of the smallest one of the amount of the unburnt fuel component adsorbed, the amount of $O_2$ in the exhaust gases, and the reaction rate calculated.

11. A catalyst temperature estimation device, comprising:

a catalytic converter carrying a catalyst disposed in an exhaust passage of an engine for converting exhaust gases to less harmful substances;

an adsorbed unburnt-fuel-component quantity calculation element for calculating the amount of an unburnt fuel component adsorbed on the catalyst in a fuel cut period of the engine;

an exhaust $O_2$ quantity calculation element for calculating the amount of $O_2$ in the exhaust gases in the fuel cut period;

an oxidation reaction heat calculation element for calculating reaction heat produced when the adsorbed unburnt fuel component in the amount calculated by the adsorbed unburnt-fuel-component quantity calculation element reacts with $O_2$ in the exhaust gases in the amount calculated by the exhaust $O_2$ quantity calculation element;

a catalyst temperature estimation element for estimating the temperature of the catalyst in the fuel cut period, on the basis of the reaction heat calculated by the oxidation reaction heat calculation element;

an adsorption rate calculation element for calculating the adsorption rate at which the unburnt fuel component is adsorbed onto the catalyst in the fuel cut period; and a desorption rate calculation element for calculating the desorption rate at which the unburnt fuel component is desorbed from the catalyst in the fuel cut period, wherein the adsorbed unburnt-fuel-component quantity calculation element calculates the amount of the unburnt fuel component adsorbed on the catalyst, on the basis of the adsorption rate calculated by the adsorption rate calculation element and the desorption rate calculated by the desorption rate calculation element.

12. The catalyst temperature estimation device according to claim 11, wherein when the amount of the unburnt fuel component in the exhaust gases is less than the calculated adsorption rate of the unburnt fuel component, the adsorption rate calculation element determines that the adsorption rate equals the amount of the unburnt fuel component in the exhaust gases.

* * * * *